United States Patent [19]

Kamijo et al.

[11] 4,455,324

[45] Jun. 19, 1984

[54] METHOD OF PRODUCING ELECTROLUMINESCENT CELL

[75] Inventors: Yoshimi Kamijo; Kazuhiko Kawachi, both of Furukawa, Japan

[73] Assignee: Alps Electric Co., Ltd., Tokyo, Japan

[21] Appl. No.: 514,703

[22] Filed: Jul. 18, 1983

Related U.S. Application Data

[62] Division of Ser. No. 307,885, Oct. 2, 1981, Pat. No. 4,417,174.

[30] Foreign Application Priority Data

Oct. 3, 1980 [JP] Japan ..... 55-138423
Dec. 12, 1980 [JP] Japan ..... 55-175452

[51] Int. Cl.[3] ..... H01J 1/62; H01J 63/04; B05D 1/38; B05D 3/02

[52] U.S. Cl. ..... 427/66

[58] Field of Search ..... 427/66

[56] References Cited

U.S. PATENT DOCUMENTS 3,008,065 11/1961 Chamberlin et al. ..... 313/108
3,010,044 11/1961 Cerulli ..... 313/108
3,673,450 6/1972 Leach ..... 313/108

*Primary Examiner*—James R. Hoffman
*Attorney, Agent, or Firm*—Guy W. Shoup; Gerard F. Dunne

[57] ABSTRACT

At least either of a luminescent layer and an insulating layer in an electroluminescent cell is made of the copolymer between vinylidene fluoride and propylene hexafluoride. In producing the electroluminescent cell, the luminescent layer is formed by applying a phosphorescent paste on a transparent electrode and heat-treating it, and the insulating layer is formed by applying an insulating paste on the luminescent layer and heat-treating it.

8 Claims, 1 Drawing Figure

METHOD OF PRODUCING ELECTROLUMINESCENT CELL

This application is a division of copending application Ser. No. 307,885 filed Oct. 2, 1981 now U.S. Pat. No. 4,417,174.

BACKGROUND OF THE INVENTION

The present invention relates to a dispersion type electroluminescent cell which is caused to luminesce by applying an electric field to phosphorescent powder, and also to a method of producing the same.

It has been well known that, when an electric field is applied to phosphorescent powder such as ZnS with manganese diffused therein, the phosphorescent powder luminesces. Electroluminescent cells exploiting this phenomenon or electroluminescence (EL) have been developed as display devices. However, prior-art electroluminescent cells have had various problems, and few have been put into practical use.

FIG. 1 is a sectional view showing the fundamental structure of a typical electroluminescent cell. Numeral 1 designates a transparent electrode which is formed on one surface of a transparent insulating substrate 2 such as a glass substrate or a plastic film substrate. The transparent electrode 1 may be made of a thin film of $In_2O_3$, $SnO_2$ or the like whose sheet resistance is not higher than several kΩ per $cm^2$, a thin film of a metal such as gold or palladium, an aluminum foil which is formed into a mesh having apertures, or the like. Numeral 3 indicates a counter electrode, which is constructed of a metal powder of silver or the like dispersed in a binder of an organic polymer or an inorganic material, or a metal sheet of aluminum, copper or the like adhered to an insulating layer 5. An ordinary electroluminescent cell has the following structure. Between the transparent electrode 1 and the opposing counter electrode 3, opposing to there are sandwiched a luminescent layer in which a phosphorescent powder such as ZnS doped with an activator such as copper and manganese and a coactivator such as chlorine is dispersed in an organic polymer binder, and an insulating layer 5 in which a high-permittivity powder such as $TiO_2$ or $BaTiO_3$ is dispersed in an organic polymer binder. Further, the entire lamination is covered with a moisture-proof protective film 6 made of polytrifluorochloroethylene, an epoxy resin or the like. As the phosphorescent powder, some cells utilize a rare-earth element, a monovalent metal, a transition metal, etc. When an A.C. voltage is applied across both the electrodes 1 and 3 in the cell of FIG. 1, an electric field corresponding to the magnitude and frequency of the A.C. voltage acts on the luminescent layer 4 to cause it to luminesce. In order to make the luminous intensity high, the following measures can be taken:

(1) The applied voltage can be raised.

(2) The luminescent layer 4 and the thickness of the insulating layer 5 can be reduced.

(3) An organic polymner binder having high permittivity can be used for the luminescent layer 4 as well as the insulating layer 5.

(4) The A.C. frequency can be raised.

However, in raising the voltage or to reduce the thickness of the luminescent layer 4 and the insulating layer 5, dielectric breakdown between the electrodes 1 and 3 may occur. In order to raise the A.C. frequency, a power source needs to be prepared separately, and this is disadvantgeous. Further, when the frequency is varied, the luminescent wavelength becomes different. Accordingly, in order to enhance the luminous intensity without degrading various characteristics of the electroluminescent cell, an organic polymer binder of high permittivity may be used for the luminescent layer 4 as well as the insulating layer 5. Cyanoethylated cellulose or an epoxy resin have heretofore been employed as the organic polymer binder, but such materials have the following disadvantages. Although the cyanoethylated cellulose exhibits a high permittivity, it is weak in film adhesion, and further, it has an inferior heat-proof property and moisture-proof property. Although the epoxy resin is somewhat excellent in its heat-proof property and its moisture-proof property, it exhibits a low permittivity.

Moreover, the phosphorescent powder typically used in the electroluminescent cell has the weak point that, when supplied with a voltage in a moist state, it is decomposed and losses its luminescing function within a very short time. Therefore, even when covered with the moisture-proof protective film 6, the prior-art electroluminescent cell is not totally immune against moisture, and may have a short lifetime and not be highly reliable.

SUMMARY OF THE INVENTION

An object of the present invention is to eliminate the disadvantages described above and to provide an electroluminescent cell which is excellent in its heat-proof property and its moisture-proof property, whose luminous intensity is high and which is reliable.

The present invention is characterized in that a copolymer between vinylidene fluoride and propylene hexafluoride with a vulcanizing agent added thereto is used as the organic polymer binder for the luminescent layer 4 as well as the insulating layer 5.

DETAILED DESCRIPTION OF THE INVENTION

Figure 1:
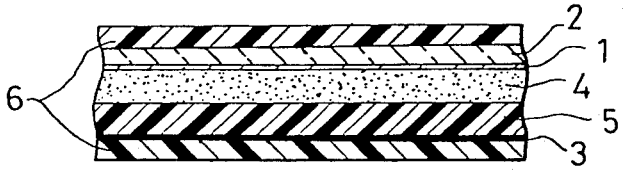
FIG. 1 of the single drawing is a partial enlarged side sectional view showing the fundamental construction of an electroluminescent cell.

The copolymer between vinylidene fluoride and propylene hexafluoride is usually called "fluorine rubber". It is highly flexible, has a permittivity of 15 (at 60 Hz), exhibits a high bonding power, and is most excellent in its heat-proof property and the moisture-proof property among rubbers. When its copolymer between vinylidene fluoride and propylene hexafluoride having these superior properties, with a vulcanizing agent added thereto, is used as the organic polymer binder for the luminescent layer 4 as well as the insulating layer 5, the electroluminescent cell fabricated is excellent in its heat-proof property and its moisture-proof property, high in luminous intensity, long in lifetime, and high in reliability.

Hereunder, the present invention will be described in connection with examples with reference to FIG. 1.

EXAMPLE 1

First, on a transparent substrate 2 such as a glass substrate, an etching process, a screen-printing process, an evaporation process or the like was used to form a transparent electrode 1 of a thin film of $In_2O_3$, $SnO_2$ or the like; a metal thin film of gold, palladium or the like;

or an aluminum foil formed into a mesh having apertures; or the like. A phosphorescent paste was applied on the transparent electrode 1 by a spraying method, application with a brush, a screen-printing process or the like method, and was thereafter heat-treated at 150° C. for 10 hours to be vulcanized and to form a luminescent layer 4. The phosphorescent paste was prepared in such a way that a vulcanizing agent and a solvent and also phosphorescent powder were added and mixed into an uncured rubber formed from a copolymner of vinylidene fluoride and propylene hexafluoride. By way of example, the following method was used. First, the uncured rubber was dissolved in an organic solvent such as acetone and methyl ethyl ketone, to form a 25% solution (denoted by [A]). Subsequently, the vulcanizing agent such as an amine, polyol or peroxide was dissolved in the organic solvent, to form a 2% solution (denoted by [B]). These solutions and the phosphorescent powder were mixed at a compounding ratio of [A]:[B]:phosphorescent powder=4:1:7, to prepare the phosphorescent paste. The luminescent layer 4 formed by the use of such a phosphorescent paste was formed into a dense film 20–30 μm thick, and was not soluble in the organic solvent. At the next step, an insulating paste was applied on the luminescent layer 4 by a spraying method, application with a brush, a screen-printing process or the like and was heat-treated at 150° C. for 10 hours to be vulcanized and to form the insulating layer 5. The insulating layer 5 was approximately 25 μm thick, and was not soluble in the organic solvent. By way of example, the insulating paste was prepared in a manner similar to the preparation of the phosphorescent paste, i.e. both the solutions [A] and [B] formed and were mixed with a high-permittivity powder such as $TiO_2$ at a compounding ratio of [A]:[B]:$TiO_2$ powder=4:1:1.5. Subsequently, an electrode 3 formed by a silver paste or from a sheet of a metal such as aluminum or copper, or the like was formed on the insulating layer 5 by known methods. Lastly, the resultant lamination was generally covered with a moisture-proof protective film 6 made of polytrifluorochloroethylene, an epoxy resin or the like. Then, the electroluminescent cell was finished up. When an A.C. voltage of 100 V at 50 Hz was applied across the transparent electrode 1 and the counter electrode 3 of the electroluminescent cell thus fabricated, the luminance brightness was approximately 25 cd/m$^2$ and was double that in the prior art. A heat-resisting load test under conditions of 85° C., 100 V and 50 Hz and a moisture-resisting load test under conditions of 40° C., 90–95% RHM, 100 V and 50 Hz were conducted. Then, the period of half decay of the luminance brightness was 1,000 H in the heat-resisting load test and 2,000 H in the moisture-resisting load test. These values were over 20 times greater than those of the prior-art cell.

Although a fluorine rubber was used for both the luminescent layer and the insulating layer in the example described above, a similar effects are attained even when it is used for only one of them.

EXAMPLE 2

First, uncured rubber formed as a copolymer of vinylidene fluoride and propylene hexafluoride was dissolved in an organic solvent such as acetone and methyl ethyl ketone, to form a 25% solution (denoted by [A]). Subsequently, a vulcanizing agent such as an amine, polyol or peroxide was dissolved in the organic solvent, to form a 2% solution (denoted by [B]). These solutions and phosphorescent powder were mixed at a compounding ratio of [A]:[B]:phosphorescent powder=4:1:7, to prepare a phosphorescent paste. Subsequently, on a transparent substrate 2 such as a glass substrate, a transparent electrode 1 was formed by an etching process, a screen-printing process or the like of a thin film of $In_2O_3$, $SnO_2$ or the like; a metal thin film of gold or the like; an aluminum foil formed into a mesh having apertures; or the like. The phosphorescent paste was applied on the transparent electrode 1 by a spraying method, an application with a brush, a screen-printing process or the like, and was dried at 70° C. for 15 minutes. Then, a luminescent layer which was 20–30μ thick, which was dense and which was not vulcanized was formed.

On the other hand, an insulating paste in which the solution [A], the solution [B] and $TiO_2$ were respectively mixed at a compounding rate of 4:1:1.5 was applied on a counter electrode 3 made of a metal sheet of Al, Cu or the like and was dried at 70° C. for 15 minutes. Then, an insulating layer which was approximately 20μ thick and which was not vulcanized was formed. While the unvulcanized luminescent layer and the unvulcanized insulating layer were kept pressed in opposition to each other, they were vulcanized at 150° C. for 4 hours. By the vulcanization, both the layers were bonded at a sufficient strength required for the electroluminescent cell. They did not need reheating, and were not separated by the organic solvent. Lastly, the resultant lamination was wholly covered with a moisture-proof protective film 6 of polytrifluorochloroethylene, an epoxy resin or the like. Then, the electroluminescent cell was finished up. When an A.C. voltage of 100 V at 50 Hz was applied across the electrodes 1 and 3 of the electroluminescent cell thus fabricated, the luminance brightness was approximately 20 cd/m$^2$. When a heat-resisting load test under conditions of 85° C., 100 V and 50 Hz and a moisture-resisting load test under conditions of 40° C., 90–95% RHM, 100 V and 50 Hz were conducted, the period of half decay of the luminance brightness was 1,000 H in the heat-resisting load test and 2,500 H in the moisture-resisting load test. In this manner, especially the moisture-proof property was favorable.

EXAMPLE 3

Likewise to Example 2, a phosphorescent paste was applied on a transparent electrode 1 and thereafter vulcanized in an oven at 150° C. for 4 hours. Thus, a luminescent layer 4 was formed. Further, an insulator paste in which the solution [A] and $TiO_2$ were respectively mixed at a compounding ratio of 4:1.5 and which did not contain any vulcanizing agent was applied on the luminescent layer 4 and then dried. Thus, an insulating layer containing no vulcanizing agent was formed. On the other hand, the solution [B] was applied on a counter electrode 3 made of a metal sheet of Al, Cu or the like and then dried. Thus, a vulcanizing agent layer was formed. While the vulcanizing agent layer and the insulating layer containing no vulcanizing agent were pressed in opposition to each other, they were vulcanized at 150° C. for 4 hours. When the resultant lamination was thereafter covered entirely with a moisture-proof protective film 6 of polytrifluorochloroethylene or the like, the electroluminescent cell was finished up. The completed electroluminescent cell had the same performance as those of Examples 1 and 2.

EXAMPLE 4

Likewise to Example 2, an insulating paste was applied on a counter electrode 3 and thereafter vulcanized in an oven at 150° C. for 4 hours. Thus, an insulating layer 5 was formed. Further, a phosphorescent paste in which the solution [A] and phosphorescent powder were respectively mixed at a compounding ratio of 4:1.5 and which did not contain any vulcanizing agent was applied on the insulating layer 5 and then dried. Thus, a luminescent layer containing no vulcanizing agent was formed. On the other hand, the solution [B] was applied on a transparent electrode 1 and then dried. Thus, a vulcanizing agent layer was formed. While the vulcanizing agent layer and the luminescent layer containing no vulcanizing agent were pressed in opposition to each other, they were vulcanized at 150° C. for 4 hours. When the resultant lamination was thereafter covered entirely with a moisture-proof protective film 6 of polytrifluorochloroethylene or the like, the electroluminescent cell was finished up. The completed electroluminescent cell had the same favorable performance as those of Examples 1 and 2.

As understood from the above description, according to the present invention, the copolymer between vinylidene fluoride and propylene hexafluoride with the vulcanizing agent added thereto is employed as the binder of the luminescent layer as well as the insulating layer. This brings forth the great advantage that the electroluminescent cell excellent in its heat-proof property and the moisture-proof property, high in its luminance brightness, long in lifetime and high in reliability can be provided.

We claim:

1. A method of producing an electroluminescent cell comprising the step of applying a phosphorescent paste on a transparent electrode formed on a transparent insulating substrate and thereafter heat-treating it to form a luminescent layer, and the step of applying an insulating paste on said luminescent layer and thereafter heat-treating it to form an insulating layer.

2. A method of producing an electroluminescent cell according to claim 1, wherein said phosphorescent paste is a copolymer of vinylidene fluoride and propylene hexafluoride in which an organic solvent, a vulcanizing agent and phosphorescent powder are added and mixed.

3. A method of producing an electroluminescent cell according to claim 1, wherein said insulating paste is a copolymer of vinylidene fluoride and propylene hexafluoride in which an organic solvent, a vulcanizing agent and a high-permittivity powder are added and mixed.

4. A method of producing an electroluminescent cell according to claim 1, wherein said phosphorescent paste is a copolymer of vinylidene fluoride and propylene hexafluoride in which an organic solvent, a vulcanizing agent and phosphorescent powder are added and mixed, while said insulating paste is a copolymer of vinylidene fluoride and propylene hexafluoride in which the organic solvent, the vulcanizing agent and a high-permittivity powder are added and mixed.

5. A method of producing an electroluminescent cell according to claim 1, comprising the step of pressing and heating in close contact said transparent electrode, said luminescent layer in which phosphorescent powder is dispersed in a copolymer of vinylidene fluoride and propylene hexafluoride, said insulating layer in which ferroelectric powder is dispersed in a copolymer of vinylidene fluoride and propylene hexafluoride, and a counter electrode.

6. A method of producing an electroluminescent cell according to claim 1, comprising the step of pressing and heating in close contact said luminescent layer which is disposed on said transparent electrode, which is semi-vulcanized and in which phosphorescent powder is dispersed in a copolymer of vinylidene fluoride and propylene hexafluoride, and said insulating layer which is disposed on a counter electrode, which is semi-vulcanized and in which a ferroelectric powder is dispersed in the copolymer of vinylidene fluoride and propylene hexafluoride.

7. A method of producing an electroluminescent cell according to claim 1, comprising the step of pressing and heating in close contact said insulating layer which is disposed on a counter electrode, which is vulcanized and in which a ferroelectric powder is dispersed in a copolymer of vinylidene fluoride and propylene hexafluoride, said luminescent layer which is disposed on said insulating layer, which does not contain any vulcanizing agent and in which phosphorescent powder is dispersed in the copolymer of vinylidene fluoride and propylene hexafluoride, and said transparent electrode whose surface is coated with a thin layer of a vulcanizing agent.

8. A method of producing an electroluminescent cell according to claim 1, comprising the step of pressing and heating in close contact said luminescent layer which is disposed on said transparent electrode, which is vulcanized and in which phosphorescent powder is dispersed in a copolymer of vinylidene fluoride propylene hexafluoride, said insulating layer which is disposed on said luminescent layer, which does not contain any vulcanizing agent and in which ferroelectric powder is dispersed in the copolymer of vinylidene fluoride and propylene hexafluoride, and a counter electrode whose surface is coated with a thin layer of a vulcanizing agent.

* * * * *